US008483604B2

(12) United States Patent
Egusa et al.

(10) Patent No.: US 8,483,604 B2
(45) Date of Patent: Jul. 9, 2013

(54) FIXING DEVICE AND IMAGE FORMING APPARATUS USING THE SAME

(75) Inventors: Naoyuki Egusa, Kanagawa (JP); Makoto Furuki, Kanagawa (JP); Tetsuro Kodera, Kanagawa (JP); Takashi Matsubara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 247 days.

(21) Appl. No.: 12/857,021

(22) Filed: Aug. 16, 2010

(65) Prior Publication Data

US 2011/0222935 A1 Sep. 15, 2011

(30) Foreign Application Priority Data

Mar. 12, 2010 (JP) ..... 2010-056353

(51) Int. Cl.
*G03G 15/20* (2006.01)

(52) U.S. Cl.
USPC ..... 399/336

(58) Field of Classification Search
USPC ..... 399/336, 337, 338
See application file for complete search history.

(56) References Cited

U.S. PATENT DOCUMENTS

| | | | | |
|---|---|---|---|---|
| 5,436,710 | A * | 7/1995 | Uchiyama | 399/336 |
| 2007/0183822 | A1 * | 8/2007 | Kitazawa et al. | 399/329 |
| 2008/0143881 | A1 | 6/2008 | Tsukioka | |

FOREIGN PATENT DOCUMENTS

| | | | |
|---|---|---|---|
| JP | 59095568 | A * | 6/1984 |
| JP | 06071936 | A * | 3/1994 |
| JP | A-7-191560 | | 7/1995 |
| JP | A-7-325493 | | 12/1995 |
| JP | A-2008-139666 | | 6/2008 |

OTHER PUBLICATIONS

English language abstract of JP59095568.*
Mathworld, Convex Function, available at http://mathworld.wolfram.com/ConvexFunction.html (last visited Jun. 11, 2012).*
Machine translation of Fukuoka, JP H06-071936.*
Annoted Figure 2 from Fukuoka, JP H06-071936.*
Translation of previously cited Nakamura, JP S59-095568.*

* cited by examiner

*Primary Examiner* — David Gray
*Assistant Examiner* — Sevan A Aydin
(74) *Attorney, Agent, or Firm* — Oliff & Berridge, PLC

(57) ABSTRACT

A fixing device includes a laser source that irradiates an image with laser light, the image being formed on a moving recording material with a thermoplastic image-forming material; and a support member arranged to face the laser source and having a curved portion, the curved portion being curved to extend in a recording-material moving direction and to protrude toward the laser source, the curved portion having a supporting portion of the recording material corresponding to at least an irradiation area of the laser light in a curved manner.

8 Claims, 14 Drawing Sheets

FIXING DEVICE AND IMAGE FORMING APPARATUS USING THE SAME

CROSS-REFERENCE TO RELATED APPLICATIONS

This application is based on and claims priority under 35 USC 119 from Japanese Patent Application No. 2010-056353 filed Mar. 12, 2010.

BACKGROUND

The present invention relates to a fixing device and an image forming apparatus using the fixing device.

SUMMARY

According to an aspect of the invention, there is provided a fixing device including a laser source that irradiates an image with laser light, the image being formed on a moving recording material with a thermoplastic image-forming material; and a support member arranged to face the laser source and having a curved portion, the curved portion being curved to extend in a recording-material moving direction and to protrude toward the laser source, the curved portion having a supporting portion of the recording material corresponding to at least an irradiation area of the laser light in a curved manner.

BRIEF DESCRIPTION OF THE DRAWINGS

Exemplary embodiment(s) of the present invention will be described in detail based on the following figures, wherein.

DETAILED DESCRIPTION

Exemplary Embodiment

A fixing device according to an exemplary embodiment of the present invention will be described.

Figure 1A:
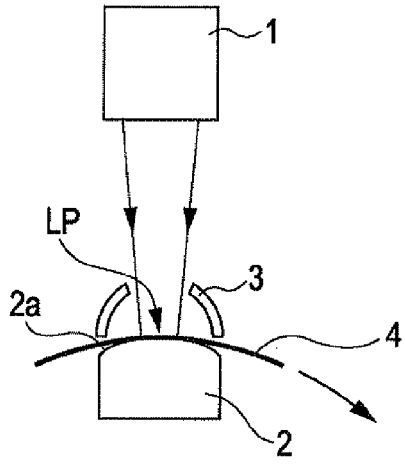
FIG. 1A schematically illustrates a fixing device according to an exemplary embodiment of the invention.

FIG. 1A illustrates a fixing device as an exemplary embodiment model for implementing the invention. The fixing device includes a laser source 1 and a support member 2. The laser source 1 irradiates an image with laser light, the image being formed on a moving recording material 4 with a thermoplastic image-forming material. The support member 2 faces the laser source 1. The support member 2 has a curved portion 2*a* curved to extend in a recording-material moving direction and to protrude toward the laser source 1. The curved portion 2*a* supports part of the recording material 4 corresponding to at least an irradiation area LP of the laser light.

The laser source 1 may be typically an array type in which plural semiconductor lasers are arranged in line in a width direction intersecting with the recording-material moving direction. However, the laser source 1 is not limited thereto. For example, plural arrays may be arranged in the recording-material moving direction, and the plural arrays may irradiate plural irradiation areas LP with light. Alternatively, instead of the array type, plural individual semiconductor lasers may be arranged. Still alternatively, a single semiconductor laser may perform scanning as long as light is provided by a sufficient light quantity.

To converge and guide the laser light from the laser source 1 to the irradiation area LP of the laser light on the surface of the recording material 4, a converging member may be used. The converging member converges the laser light emitted from the laser source 1 at least in the recording-material moving direction. The converging member may be a combination of plural lens systems, and includes an optical system that converges the laser light emitted from the laser source 1 toward the irradiation area LP.

The recording material 4 may be continuous paper (roll paper) or cut paper. The material is not limited to paper, and may be a film.

The support member 2 is not particularly specified as long as the support member 2 has a curved portion 2*a* and supports the recording material 4 such that the recording material 4 is curved along the curved portion 2*a*. The curved portion 2*a* is curved to extend in the recording-material moving direction and to protrude toward the laser source 1. The curved portion 2*a* supports the part of the recording material 4 corresponding to at least the irradiation area LP. The support member 2 may be a rotatable member or a fixed member. Also, a surface of the curved portion 2*a* may be a reflecting surface capable of reflecting the laser light. Alternatively, the surface of the curved portion 2*a* may be formed of a laser-light transmissive member, and the curved portion 2*a* may have a curved reflecting surface. The support member 2 may be made of metal or synthetic resin.

Here, the reason for the provision of the curved portion 2*a* in the support member 2 will be described.

Figure 1B:
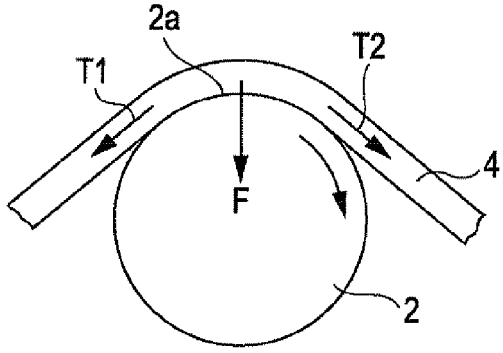
FIG. 1B is an explanatory view showing a recording material that is moved while being curved.
Figure 1C:
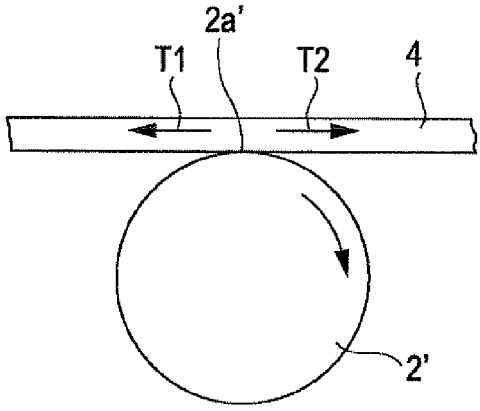
FIG. 1C is an explanatory view showing a recording material that is moved straight.

Assuming that the recording material 4 is continuous paper and is transported by a roller member as the support member 2, when an unfixed image is formed on the recording material 4, the recording material 4 may be moved in the recording-material moving direction in a protruding manner or may be moved straight as shown in FIGS. 1B and 1C. FIG. 1B illustrates a configuration according to this exemplary embodiment. The recording material 4 is curved in a protruding manner by the curved portion 2*a* of the support member 2. FIG. 1C illustrates a comparative example. The recording material 4 is moved straight. At this time, a flat surface 2*a*' of a support member 2' does not cause the recording material 4 to be curved.

If the recording material 4 is moved while being curved as shown in FIG. 1B relative to a member (corresponding to the support member 2) that contacts the recording material 4, tensions T1 and T2 act on the recording material 4 in different directions with respect to the curved portion 2*a*, at which the recording material 4 contacts the support member 2. Thus, a force F, which is a composite force of the tensions T1 and T2, acts on the recording material 4 toward the support member 2.

In contrast, referring to FIG. 1C, if the recording material 4 is moved straight, tensions T1 and T2 act in the same plane. Thus, no force acts on the recording material 4 toward the support member 2'.

The recording material 4 typically moves while the recording material 4 waves in its thickness direction. If waviness appears, an irradiation area of the laser light may vary. As a result, an irradiation intensity per unit area may vary. Due to this, fixability of toner may be unstable. Thus, the waviness of the recording material 4 in the irradiation area LP should be reduced.

If the recording material 4 is moved while being curved as shown in FIG. 1B, the recording material 4 is pressed to the support member 2 by the force F. The waviness of the moving recording material 4 may be reduced. In contrast, if the recording material 4 is moved straight as shown in FIG. 1C, the waviness of the recording material 4 is hardly reduced. Also, if the recording material 4 is moved while being curved, the curved part of the recording material 4 has apparently increased hardness. A moving posture of the recording material 4 becomes stable. Even if the recording material 4 is thin, the waviness of the recording material 4 in the irradiation area LP may be reduced.

In this exemplary embodiment, the recording material 4 is the continuous paper. However, even if the recording material 4 is cut paper, the force F acts on the recording material 4 toward the support member 2 like the continuous paper as long as the recording material 4 is attracted to the transport belt. The waviness may be reduced even for the cut paper.

If the recording material 4 is sucked and moved straight, waviness of a transport member such as a suction belt still remains, and the waviness of the recording material 4 is not reduced.

If the recording material 4 is moved in the vertical direction, the curved portion 2*a* provides a similar effect, and the waviness may be reduced.

In this exemplary embodiment, if the curved portion 2*a* has a reflecting surface, a secondary effect is expected as follows.

Figure 2A:
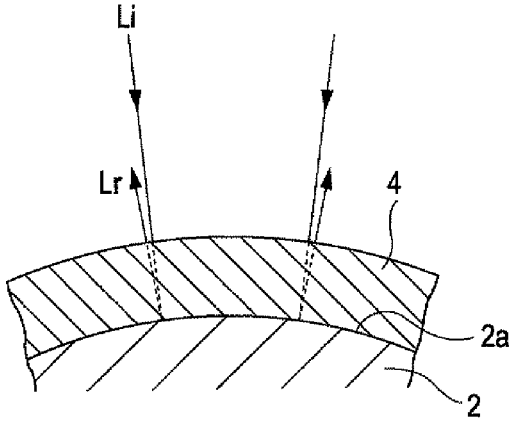
FIGS. 2A and 2B are explanatory views showing a support member with a curved portion.
Figure 2C:
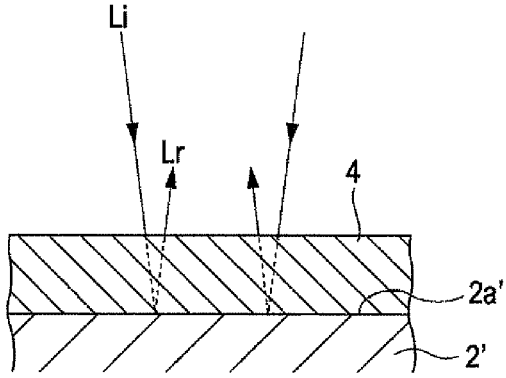
FIGS. 2C and 2D are explanatory views showing a support member without a curved portion for comparison.
Figure 2B:
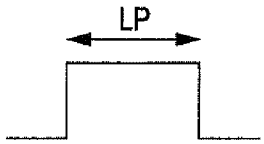
Figure 2D:
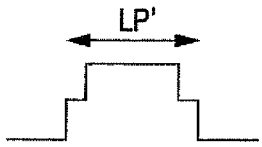

FIG. 2A illustrates incident light Li and reflected light Lr of the laser light when the support member 2 has the curved portion 2*a*. FIG. 2B illustrates a laser intensity distribution in the irradiation area LP in FIG. 2A. Herein, for example, the front surface of the curve portion 2*a* is a reflecting surface. In contrast, FIG. 2C illustrates incident light Li and reflected light Lr of the laser light when the support member 2' does not have the curved portion 2*a* but has the flat surface 2*a*' as a comparative example. FIG. 2D illustrates a laser intensity distribution in an irradiation area LP' in FIG. 2C. Herein, for example, the front surface of the flat surface 2*a*' is a reflecting surface.

If the support member 2 has the curved portion 2*a* as shown in FIG. 2A, in a view along the recording-material moving direction, the reflected light Lr that is the laser light converged on the irradiation area LP and reflected from the surface of the curved portion 2*a* tends to spread in a range including the irradiation area LP. In other words, the reflected light Lr tends to be directed outside the incident light Li. The laser intensity distribution in the irradiation area LP on the recording material 4 is substantially uniform although the incident light Li is overlapped with the reflected light Lr.

In contrast, if the support member 2' has the flat surface 2*a*' as shown in FIG. 20, the reflected light Lr from the flat surface 2*a*' is directed inside the incident light Li. The laser intensity distribution in a middle portion of the irradiation area LP' becomes high because the incident light Li is overlapped with the reflected light Lr, and the laser intensity distribution in both end portions of the irradiation area LP' become low because the effect of the reflected light Lr is reduced. That is, a difference appears in the laser intensity distribution in the irradiation area LP'.

Even in the case in FIG. 2A, the reflected light Lr may be directed inside the incident light Li depending on the incidence angle of the incident light Li to the surface of the curved portion 2*a*. Even if the curved portion 2*a* is provided, however, the reflected light Lr is directed toward both ends of the irradiation area LP as compared with the case of the flat surface 2*a*'. Hence, a region with a uniform laser intensity distribution is larger in the irradiation area LP than the case in which the flat surface 2*a*' is provided.

Since the uniform laser intensity distribution is provided in the irradiation area LP, for example, when the semiconductor lasers of the array type are driven by time-division driving or when an image is selectively irradiated with light, a stable and uniform laser intensity is provided in the recording-material moving direction. Accordingly, a fixed image with a uniform image quality is obtained.

To increase the uniformity of the laser intensity distribution in the irradiation area LP, the curved portion 2*a* of the support member 2 may have a reflecting surface capable of reflecting the laser light incident thereon via the irradiation area LP on the surface of the recording material 4 toward a range including at least the irradiation area LP. Accordingly, the reflected light Lr from the curved portion 2*a* is reflected outside the incident light Li. The uniformity of the laser intensity distribution in the irradiation area LP is increased. Further, the curved portion 2*a* of the support member 2 may have a reflecting surface capable of reflecting the laser light incident thereon via the irradiation area LP on the surface of the recording material 4 toward a range equivalent to the irradiation area LP. Accordingly, the incident light Li and the reflected light Lr are directed along the lines normal to the curved reflecting surface of the curved portion 2*a*. The laser intensity distribution in the irradiation area LP becomes uniform.

Referring to FIG. 1, to effectively use scattered light from the recording material 4 and the support member 2 as a result of the irradiation with the laser light, a reflecting member 3 may be provided between the laser source 1 and the recording material 4 supported by the support member 2. The reflecting member 3 reflects the scattered light of the laser light emitted on the irradiation area LP on the surface of the recording material 4 toward the irradiation area LP again. The shape of the reflecting member 3 is not particularly limited. For example, the reflecting member 3 may be a concave mirror in order to reflect and converge the scattered light toward the irradiation area LP. When the reflecting member 3 is used, an end of the reflecting member 3 located near to the support member 2 may be located closer to the support member 2 than a tangent to part of the curved portion 2*a* of the support member 2 located nearest to the laser source 1. Since the end of the reflecting member 3 extends toward the support member 2, the most of the scattered light from the surface of the recording material 4 to all directions as a result of the laser light is effectively reflected by the reflecting member 3 and is emitted toward the irradiation area LP again. If the reflecting member 3 is provided, when the flat surface 2*a*' is provided instead of the curved portion 2*a*, a sufficient gap is required between the recording material 4 and the reflecting member 3. Owing to this, the end of the reflecting member 3 is allowed to extend only by a smaller length than that of the reflecting member 3 when the support member 2 has the curved portion 2*a*. Part of the scattered light may be diverged through the gap.

To provide a proper transport performance for the recording material 4, the support member 2 may be a roller member that rotates in the recording-material moving direction. Thus, the proper transport performance for the recording material 4 is provided. Also, friction generated between the recording material 4 and the support member 2 is reduced, and hence dust like paper powder is rarely generated. Since an image is not rubbed with the support member 2 during duplex printing, the image is rarely disordered. In this case, the roller member may be a transport member or a member rotated by the recording material 4 during transport. The roller member is particularly desirable when the recording material 4 is continuous paper.

To have the proper transport performance for the recording material 4, another example of the support member 2 may include a belt-like transport member that holds and transports the recording material 4, and an opposite member that contacts a surface different from a recording-material transport surface of the belt-like transport member and causes the belt-like transport member to protrude toward the laser source 1. The belt-like transport member may be, for example, an air suction type or an electrostatic attraction type. For the air suction type, the belt-like transport member may have multiple very small holes, so that the air is sucked from the back surface of the belt-like transport member. For the electrostatic attraction type, a charging member may be provided upstream the irradiation area LP in a moving direction of the belt-like transport member. The charging member causes the recording material 4 to be attracted to the belt-like transport member.

In this example of the support member 2, when a curved reflecting surface is provided for the curved portion 2*a*, the surface of the belt-like transport member may have the reflecting surface. Alternatively, the belt-like transport member may be formed of a laser-light transmissive material, and the surface of the opposite member may have the reflecting surface. Still alternatively, the surface of the belt-like transport member and the surface of the opposite member both may have the reflecting surfaces.

When such a fixing device is attached to an image forming apparatus, it is only required to couple an image forming unit that forms an image on a recording material 4 with a thermoplastic image-forming material, with a transport unit for the recording material 4. To further reduce the waviness of the recording material 4, the recording material 4 continuously extending in the recording-material moving direction may be desirably used.

A typical example of the thermoplastic image-forming material may be toner that is used for electrophotographic system; however, it is not limited thereto. For example, the thermoplastic image-forming material may be ink of heated and melted type that is used for inkjet system.

Next, exemplary embodiments shown in figures will be described in more detail below.

First Exemplary Embodiment

Figure 3:
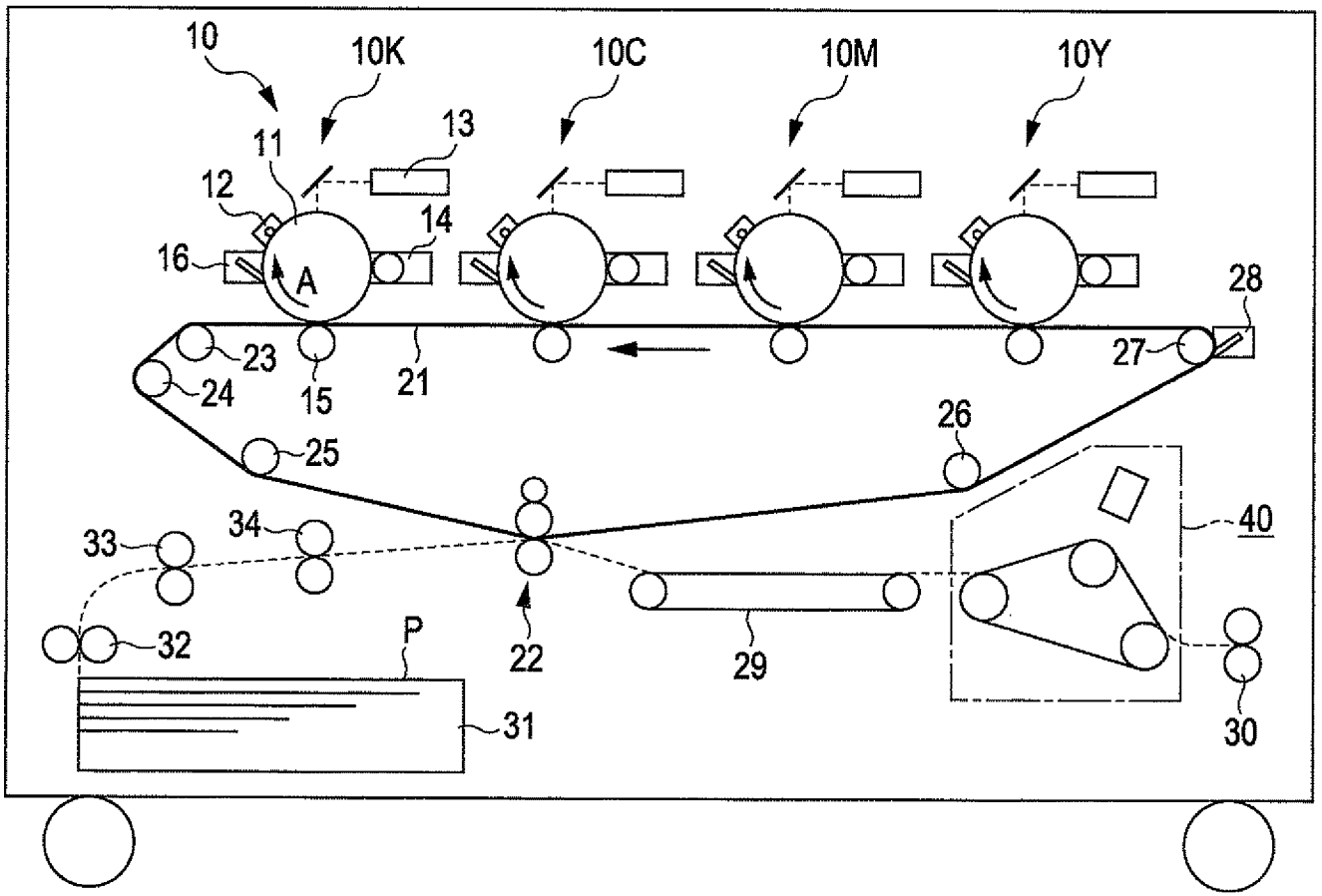
FIG. 3 is an explanatory view schematically showing a general configuration of an image forming apparatus according to a first exemplary embodiment.

FIG. 3 is an explanatory view schematically showing a general configuration of an image forming apparatus according to a first exemplary embodiment to which the fixing device according to the aforementioned exemplary embodiment is applied.

In FIG. 3, the image forming apparatus is, for example, electrophotographic type. The image forming apparatus includes image forming units 10 (more specifically, a black image forming unit 10K, a cyan image forming unit 10C, a magenta image forming unit 10M, and a yellow image forming unit 10Y) that form toner images with plural colors on a recording material P by using, for example, four-color toners, as thermoplastic image-forming materials; an intermediate transfer belt 21 that bears the toner images of the respective colors formed by the image forming units 10 in a superposed manner; a collective transfer device (a second transfer device) 22 that collectively transfers the superposed toner images on the intermediate transfer belt 21 onto the recording material P, such as a recording sheet (cut paper); and a fixing device 40 that fixes the unfixed toner images transferred on the recording material P by the second transfer device 22, to the recording material P. The arrangement order of the image forming units 10 is not limited to the aforementioned order. The image forming units 10 may be desirably arranged, and the number of the image forming units 10 may be desirably determined.

The image forming units 10 have a configuration similar to one another except that the image forming units 10 use toners of different colors. Therefore, the black image forming unit 10K will be described for example. The black image forming unit 10K includes a cylindrical photoconductive member 11 that includes a photoconductive layer (not shown) on the surface thereof and is rotatable in a direction indicated by arrow A. Provided around the photoconductive member 11 are a charging device 12 that electrically charges the photoconductive layer of the photoconductive member 11 to have a predetermined potential; an exposing device 13 that selectively irradiates the photoconductive layer charged by the charging device 12 with, for example, laser light to form an electrostatic latent image; a developing device 14 that develops the electrostatic latent image formed by the exposing device 13 with toner to visualize the image as a toner image; a first transfer device 15 that transfers the toner image on the photoconductive member 11 onto the intermediate transfer belt 21; and a cleaner 16 that cleans remaining toner on the photoconductive member 11 after the toner image is transferred on the intermediate transfer belt 21.

Referring to FIG. 3, support rollers 23 to 27 support the intermediate transfer belt 21 with a tension. A belt cleaner 28 cleans remaining toner on the intermediate transfer belt 21 after second transfer. A transport belt 29 transports the recording material P to the fixing device 40 after the second transfer. An output roller 30 outputs the recording material P outside the image forming apparatus after the fixing. A recording material container 31 contains the recording material P before the image formation. Transport rollers 32 to 34 transport the recording material P to a second transfer position.

In this exemplary embodiment, the first transfer devices 15 transfer the toner images of the respective colors formed on the photoconductive members 11 by the image forming units 10, onto the intermediate transfer belt 21. Thus, the superposed toner images are formed on the intermediate transfer belt 21. Meanwhile, the transport rollers 32 to 34 transport the recording material P from the recording material container 31 to the second transfer position, at which the second transfer device 22 collectively transfers the superposed toner images on the intermediate transfer belt 21, onto the recording material P. The transport belt 29 transports the recording material P with the superposed toner images collectively transferred by the second transfer device 22. Then, the fixing device 40 fixes the superposed toner images to the recording material P. The output roller 30 outputs the recording material P outside the image forming apparatus after the fixing.

Next, the fixing device 40 according to this exemplary embodiment will be described in detail with reference to FIGS. 4A and 4B.

Figure 4A:
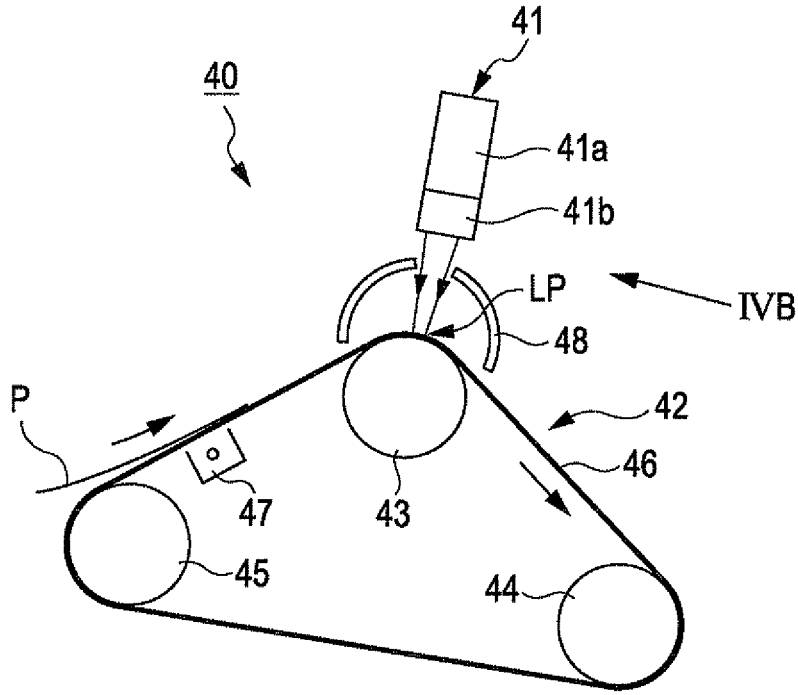
FIG. 4A is a schematic diagram showing a fixing device according to the first exemplary embodiment.
Figure 4B:
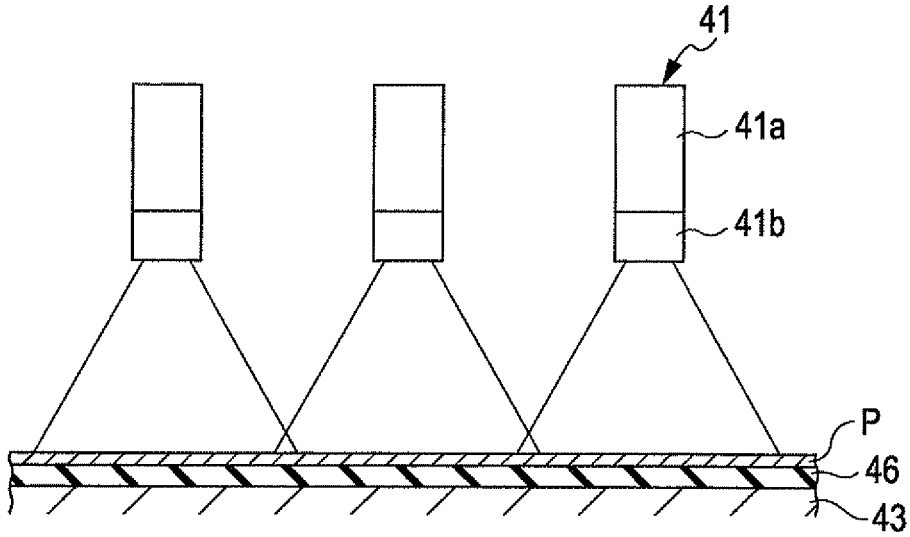
FIG. 4B is a schematic diagram viewed in a direction indicated by arrow IVB in FIG. 4A.

FIG. 4A is a schematic diagram showing the fixing device 40 according to this exemplary embodiment in a view of a cross section along a recording-material transport direction. FIG. 4B is a schematic diagram showing laser irradiation devices 41 (described later) and laser light viewed in a direction indicated by arrow IVB in FIG. 4A.

The fixing device according to this exemplary embodiment includes a laser irradiation device 41 having a laser source 41*a* and a converging member 41*b* having an optical system such as a lens, the laser source 41*a* being integrally provided with the converging member 41*b*; a support member 42 having a curved portion that faces the laser irradiation device 41 with the recording material P arranged therebetween and is curved to extend in the recording-material moving direction and to protrude toward the laser irradiation device 41, the support member 42 supporting part of the recording material P corresponding to at least the irradiation area LP such that the recording material P extends along the curved portion; and a reflecting member 48 that reflects the scattered light of the laser light emitted on the irradiation area LP by the laser irradiation device 41, toward the irradiation area LP.

The laser irradiation device 41 includes the laser source 41*a* and the converging member 41*b* that are integrally provided with one another. The converging member 41*b* converges the laser light, which is emitted from the laser source 41*a* toward the surface of the recording material P, particularly to the predetermined irradiation area LP extending in the recording-material moving direction, and diverges the laser light in the width direction intersecting with the recording-material moving direction. Plural (three in FIG. 4B although the number is not limited to three) laser irradiation devices 41 are provided in the width direction intersecting with the recording-material moving direction.

The support member 42 according to this exemplary embodiment includes a belt-like transport member 46. The belt-like transport member 46 is wound around three support rollers 43 to 45 in this exemplary embodiment. The support roller 44 serves as a driving roller to rotate the belt-like transport member 46. A contact portion between the support roller 43 and the belt-like transport member 46 is wide. The belt-like transport member 46 is moved along the outer peripheral surface of the support roller 43 at the contact portion. Thus, the curved portion is formed at the surface of the belt-like transport member 46. The irradiation area LP with the laser light from the laser irradiation device 41 is formed on part of the surface of the recording material P corresponding to the curved portion.

To increase the reflectivity of the surface, the belt-like transport member 46 may use a film sheet formed by mixing a white pigment into a polyimide resin material. The belt-like transport member 46 is not limited thereto, as long as the belt-like transport member 46 rotates to follow the support roller 43 and the surface reflects the laser light.

In this exemplary embodiment, for example, a corona charging unit 47 is provided at the back surface side of the belt-like transport member 46, at a position between the support roller 43 and the support roller 45. The corona charging unit 47 causes the recording material P to be attracted to the belt-like transport member 46. The corona charging unit 47 provides an electric field in a direction in which the unfixed toner on the recording material P is attracted to the belt-like transport member 46.

Also, in this exemplary embodiment, the reflecting member 48 is provided around the irradiation area LP at the front surface side of the belt-like transport member 46. The reflecting member 48 is a concave mirror and surrounds the irradiation area LP. The reflecting member 48 has an opening in a portion facing the laser irradiation device 41. The laser light passes through the opening. An end of the reflecting member 48 located near to the belt-like transport member 46 extends to a position close to the belt-like transport member 46. In this exemplary embodiment, the end of the reflecting member 48 extends toward the belt-like transport member 46 over a tangent to part of the irradiation area LP located nearest to the laser irradiation device 41. A gap is provided between the end of the reflecting member 48 and the belt-like transport member 46. Hence, the end of the reflecting member 48 does not disturb the transportation of the recording material P.

Next, the effect of the fixing device 40 will be described.

The corona charging unit 47 provides the effect of the electric field for attracting the toner, for the recording material P with the unfixed toner images collectively transferred. With the electric field, the belt-like transport member 46 and the recording material P are electrically charged. Thus, the recording material P is attracted to the surface of the belt-like transport member 46. The recording material P attracted to the belt-like transport member 46 is transported through the rotation of the belt-like transport member 46, and reaches the irradiation area LP. The recording material P is irradiated with the laser light in the irradiation area LP, and the toner on the recording material P is fixed. The recording material P is further transported through the rotation of the belt-like transport member 46, is separated from the belt-like transport member 46 by a separation claw or the like (not shown), and is guided to the output roller 30 (see FIG. 3).

Figure 5A:
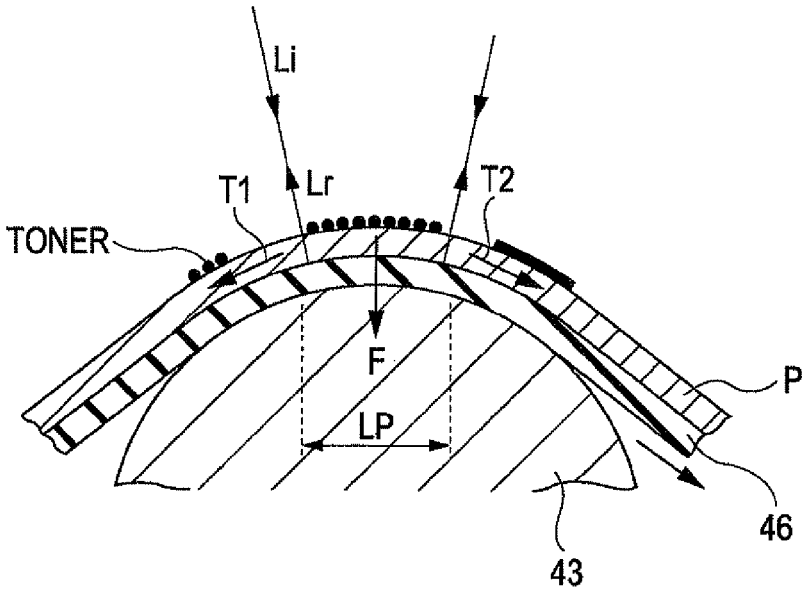
FIG. 5A is an explanatory view showing an effect in an irradiation area of the fixing device according to the first exemplary embodiment.

FIG. 5A illustrates a relationship between the laser light and the recording material P in the irradiation area LP according to this exemplary embodiment. The toner on the recording material P located upstream the irradiation area LP in the recording-material moving direction is not fixed. The toner located downstream the irradiation area LP is fixed. In this exemplary embodiment, referring to FIGS. 5A and 5B, since the recording material P is attracted to the belt-like transport member 46, a force acts on the recording material P in a direction in which the recording material P is attracted toward the belt-like transport member 46. Also, since the support rollers 43 to 45 apply a tension to the belt-like transport member 46, the recording material P is transported while being pressed to the support roller 43. Hence, the waviness of the recording material P transported through the movement of the belt-like transport member 46 may be reduced.

In this exemplary embodiment, the recording material P is tensed in the irradiation area LP in an arc form because of the curved portion. The hardness of the recording material P is apparently increased. As a result, the waviness of the recording material P in the irradiation area LP may be further reduced. The laser intensity in the irradiation area LP may become stable.

In this exemplary embodiment, the incident light Li from the laser irradiation device 41 (for example, see FIG. 4A) to the irradiation area LP passes through substantially the same optical path as the optical path of the reflected light Lr from the surface of the belt-like transport member 46, which is at the lower surface side of the recording material P. That is, the incident light Li and the reflected light Lr in the irradiation area LP is directed along the lines normal to the curved portion of the belt-like transport member 46 in the irradiation area LP. Accordingly, the uniform laser intensity is provided for the toner in the irradiation area LP. When the reflected light Lr is reflected from the surface of the belt-like transport member 46, for example, about 30% of the incident light Li is reflected from the surface although the reflectivity may vary depending on the type of the recording material P to be used.

Figure 5B:
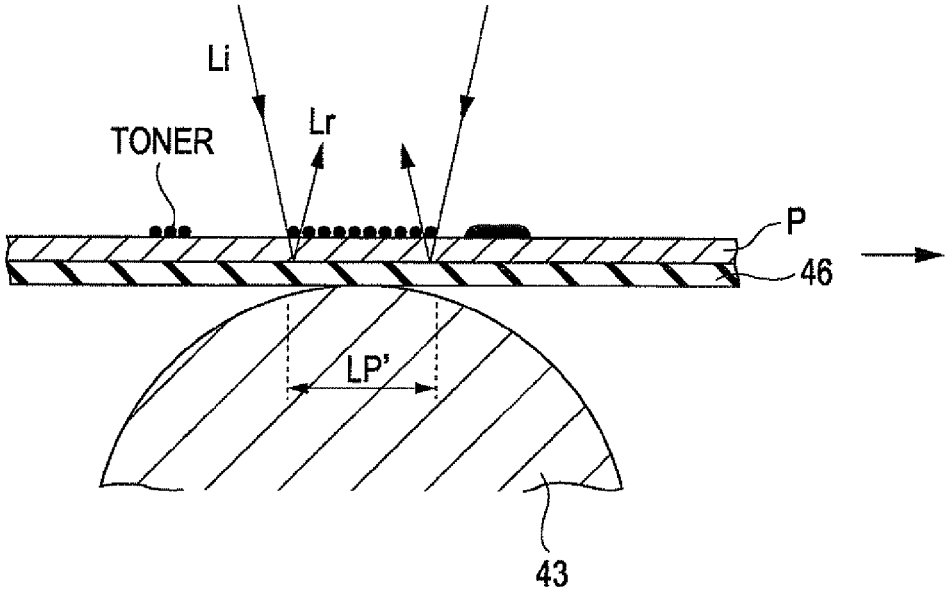
FIG. 5B is an explanatory view showing an effect in a flat irradiation area according to a comparative example.

Referring to FIG. 5B, if the curved portion is not provided, the force toward the support roller 43 does not act on the recording material P. Thus, the waviness of the recording material P to be transported still remains.

In this case, the reflected light Lr from the belt-like transport member 46 is reflected inside the irradiation area LP'. Hence, the laser intensity in both end portions (in the recording-material moving direction) of the irradiation area LP' is lower than the laser intensity in the middle portion of the irradiation area LP'. The uniformity of the laser intensity in the irradiation area LP' is reduced.

Figure 6A:
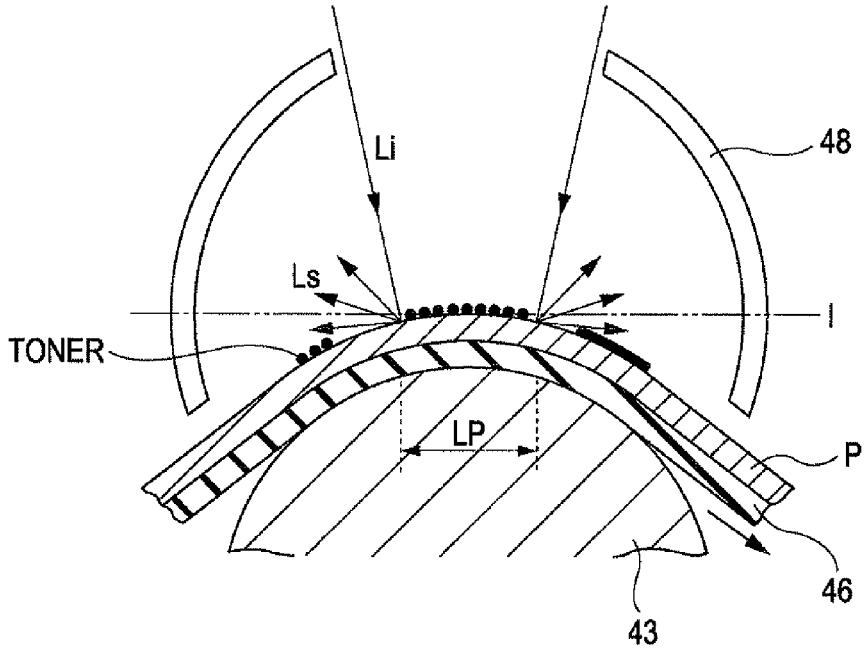
FIG. 6A is an explanatory view showing an effect by a reflecting member according to the first exemplary embodiment.

Further, in this exemplary embodiment, the reflecting member 48 is provided at the laser irradiation device 41 side with respect to the irradiation area LP as shown in FIG. 6A. In this exemplary embodiment, since the belt-like transport member 46 has the curved portion, the end of the reflecting member 48 located near to the recording material P may markedly extend closer to the belt-like transport member 46 than the tangent (indicated by 1 in FIG. 6A) to the part of the irradiation area LP located nearest to the laser irradiation device 41. The scattered light of the incident light Li scattered from the surface of the recording material P (herein, the scattered light being referred to as scattered light Ls spreading to all directions for the convenience of understanding) is effectively received by the reflecting member 48, and is reflected to the irradiation area LP again. Thus, the laser light may be further efficiently used.

Figure 6B:
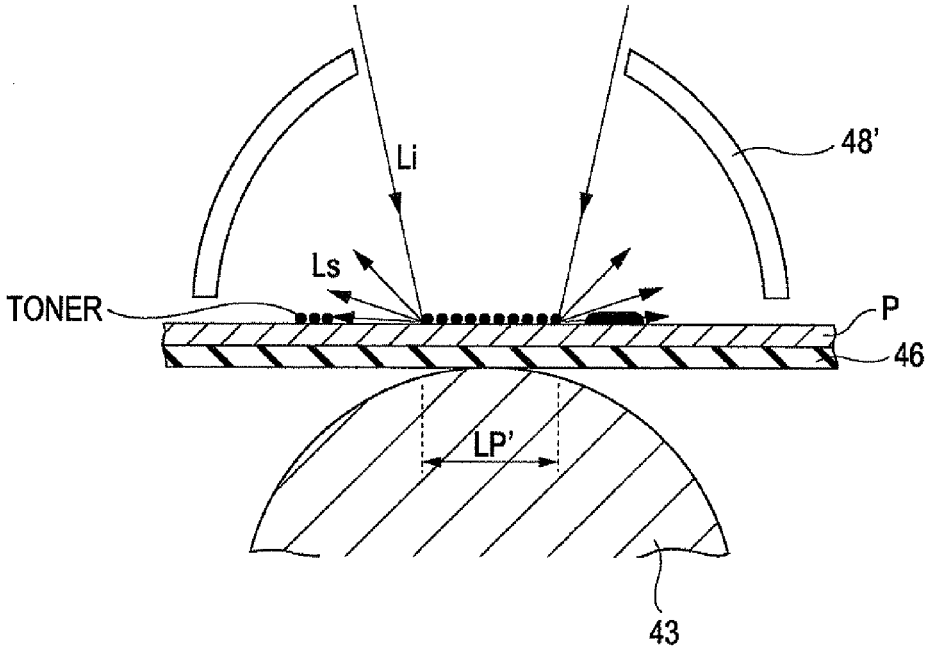
FIG. 6B is an explanatory view showing an effect of a reflecting member according to a comparative example.

In contrast, if the curved portion is not provided as shown in FIG. 6B, an end of a reflecting member 48' located near to the recording material P is located at a position above the irradiation area LP' because a gap is required between the end of the reflecting member 48' and the recording material P. Owing to this, part of the scattered light Ls from the irradiation area LP' passes through the reflecting member 48'. The efficiency in use of the laser light is reduced as compared with the case in which the curved portion is provided.

In this exemplary embodiment, the recording material P is cut paper. However, the recording material may be continuous paper. In this exemplary embodiment, the corona charging unit 47 is provided at the back surface side of the belt-like transport member 46 so that the recording material P is attracted to the belt-like transport member 46. In addition to the corona charging unit 47, another corona charging unit that provides electric charge with the same polarity as the polarity of the toner may be provided at the front surface side of the belt-like transport member 46. Alternatively, instead of the corona charging unit 47, a support roller may be provided at the back surface side of the belt-like transport member 46 so that the support roller contacts the belt-like transport member 46. The support roller may have an electric field with a polarity different from the polarity of the toner.

In this exemplary embodiment, the belt-like transport member 46 is formed by mixing the pigment into the material of the belt-like transport member 46. However, the belt-like transport member 46 may have a reflecting layer as a surface layer, and a light absorbing layer below the surface layer.

Figure 7:
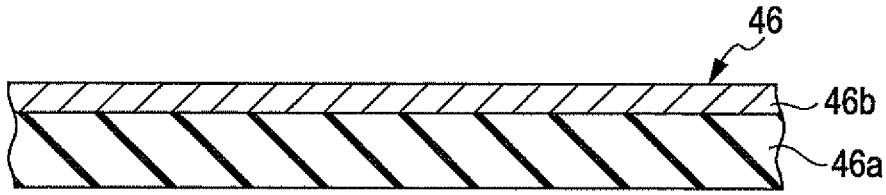
FIG. 7 is an explanatory view showing a modification of a belt-like transport member with a plural layer structure.

FIG. 7 illustrates a belt-like transport member 46 having a two-layer structure including a belt base member 46*a* and a surface layer 46*b*. The surface layer 46*b* is formed by applying a white pigment on the front surface of the belt base member 46*a*. When the belt-like transport member 46 is used, the surface layer 46*b* functions as the reflecting layer, and provides a similar effect to that of the single-layer structure with the pigment mixed.

Alternatively, in this case, the belt base member 46*a* may serve as a light absorbing layer that absorbs laser light. For example, it is assumed that the belt-like transport member 46 is stopped due to a trouble (jam etc.) although the laser irradiation device 41 is operated, part of the belt-like transport member 46 is continuously irradiated with the laser light for a long period, and the surface layer 46*b* is damaged. Even in this case, the damage does not spread because of the light absorption effect of the belt base member 46*a*. For example, the belt base member 46*a* may be formed by mixing a light absorption agent suitable for laser light into polyimide resin.

In the exemplary embodiment, the surface of the belt-like transport member 46 is the reflecting surface; however, it is not limited thereto. For example, the belt-like transport member 46 may be formed of a laser-light transmissive material, and the surface of the support roller 43 (for example, see FIG. 4A) may be the reflecting surface.

In this exemplary embodiment, the belt-like transport member 46 is wound around the support roller 43 as the support member that supports the recording material P in the irradiation area LP; however, it is not limited thereto. For example, a fixing member having a curved portion may be used instead of the support roller 43.

Figure 8:
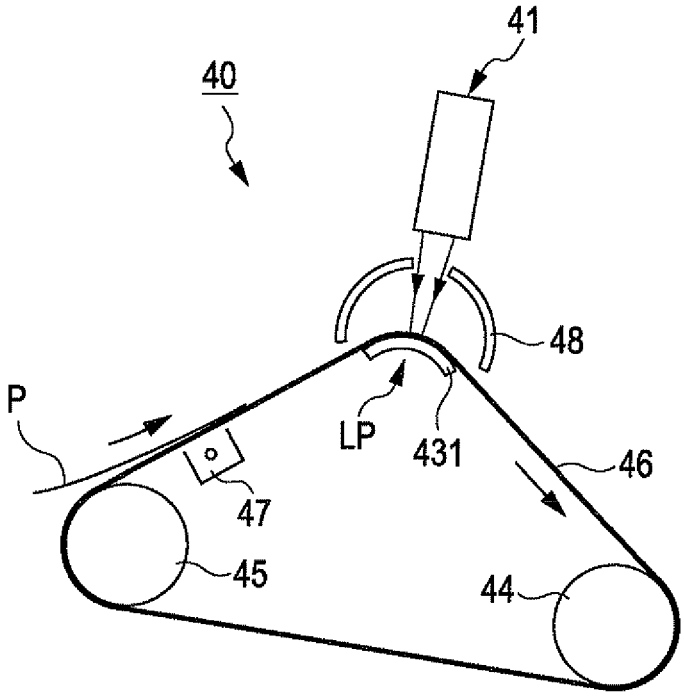
FIG. 8 is an explanatory view showing a modification of the fixing device according to the first exemplary embodiment.

FIG. 8 illustrates a modification of the fixing device 40 that uses a fixing member. In this modification, a belt-like transport member 46 is wound around and rotated by two support rollers 44 and 45 and a curved fixing member 431. Since the fixing member 431 has a curved portion, an irradiation area LP is provided in correspondence with the curved portion. Also, the surface shape of the fixing member 431 is determined such that an optical path of incident light of irradiating laser light is the same as an optical path of reflected light. Accordingly, the modification attains an effect similar to that of the fixing device 40 shown in FIG. 4A. The shape of the fixing member 431 is not limited thereto, and may be desirably determined as long as the fixing member 431 has the curved portion.

Figure 9A:
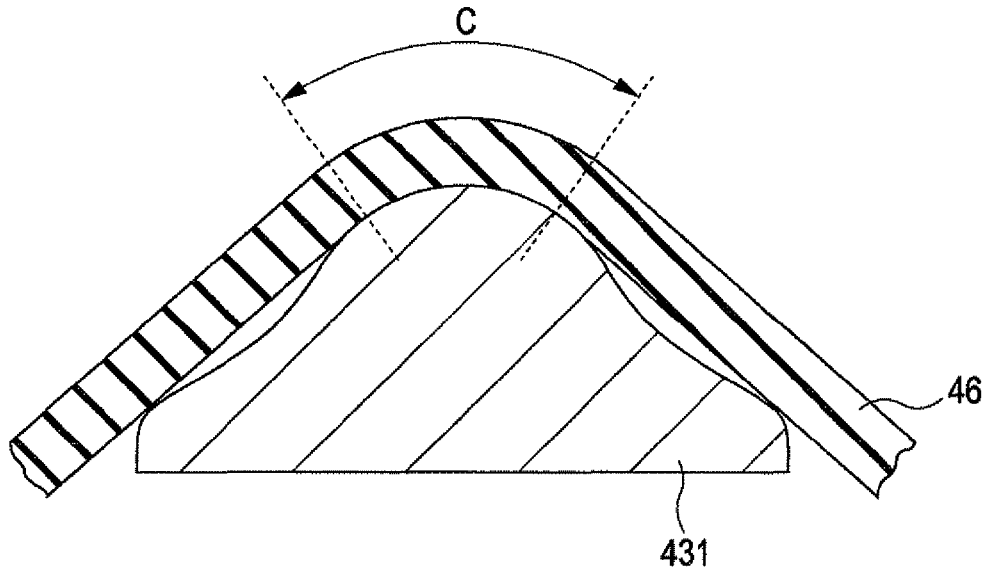
FIGS. 9A and 9B are explanatory views showing modifications of the fixing member in FIG. 7.
Figure 9B:
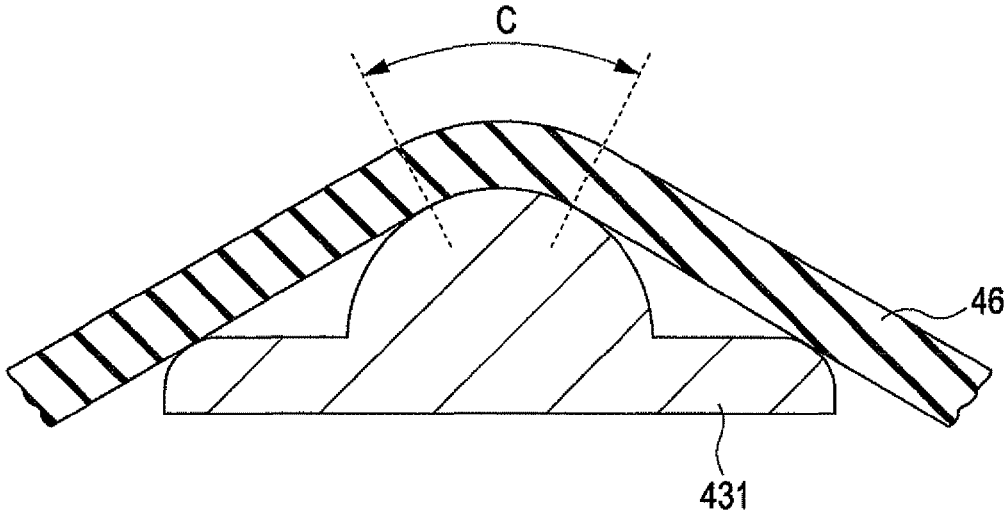

FIGS. 9A and 9B illustrate modifications of the fixing member 431. Fixing members 431 partly have curved portions. The curved portions of the fixing members 431 in FIGS. 9A and 9B have different shapes. Since the belt-like transport member 46 are moved along the curved portions, irradiation areas LP may be provided within ranges indicated by arrows C in FIGS. 9A and 9B.

Figure 10A:
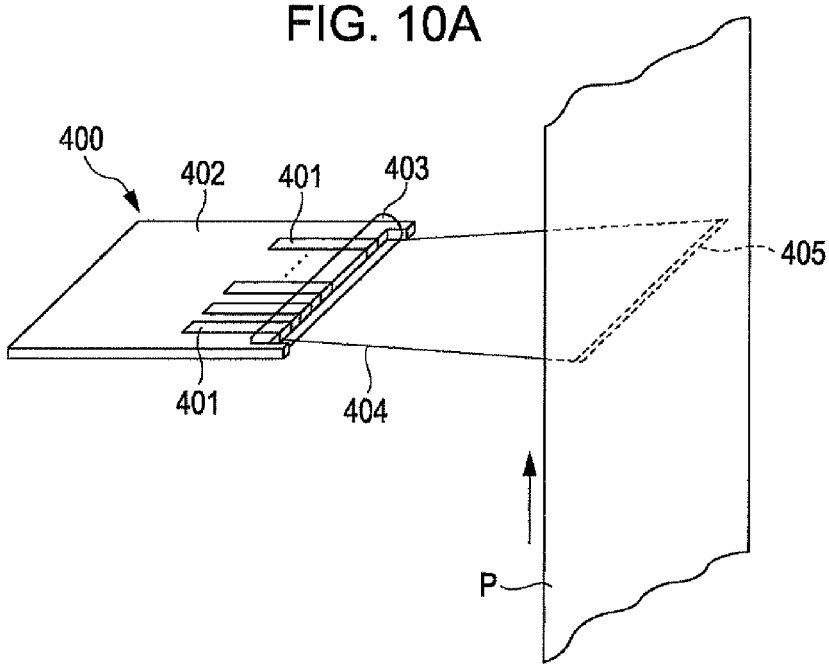
FIG. 10A is an explanatory view showing an example of a laser array in a laser irradiation device.

FIG. 10A schematically illustrates an example of a laser array of the laser irradiation device 41 shown in FIG. 4A. A laser array 400 includes plural laser emitting elements 401 serving as the laser source 41*a* and arranged in line along the width direction intersecting with the recording-material transport direction; and a converging member 41*b* common to the laser emitting elements 401. In particular, the laser array 400 includes the plural laser emitting elements 401 arranged in an end portion of a single substrate 402 at even intervals, and a converging member 403 combined with laser emitting ends of the laser emitting elements 401. The converging member 403 diverges the laser light from the laser emitting elements 401 by a predetermined quantity along the width direction intersecting with the recording-material transport direction. Also, the converging member 403 converges the laser light by a predetermined quantity in the recording-material transport direction. For example, the converging member 403 may be a columnar collimator lens extending in the width direction of the substrate 402. Laser light 404 provides an irradiation region 405 in an irradiation area LP of the recording material P. The irradiation region 405 extends substantially linearly in the width direction of the recording material P.

Figure 10B:
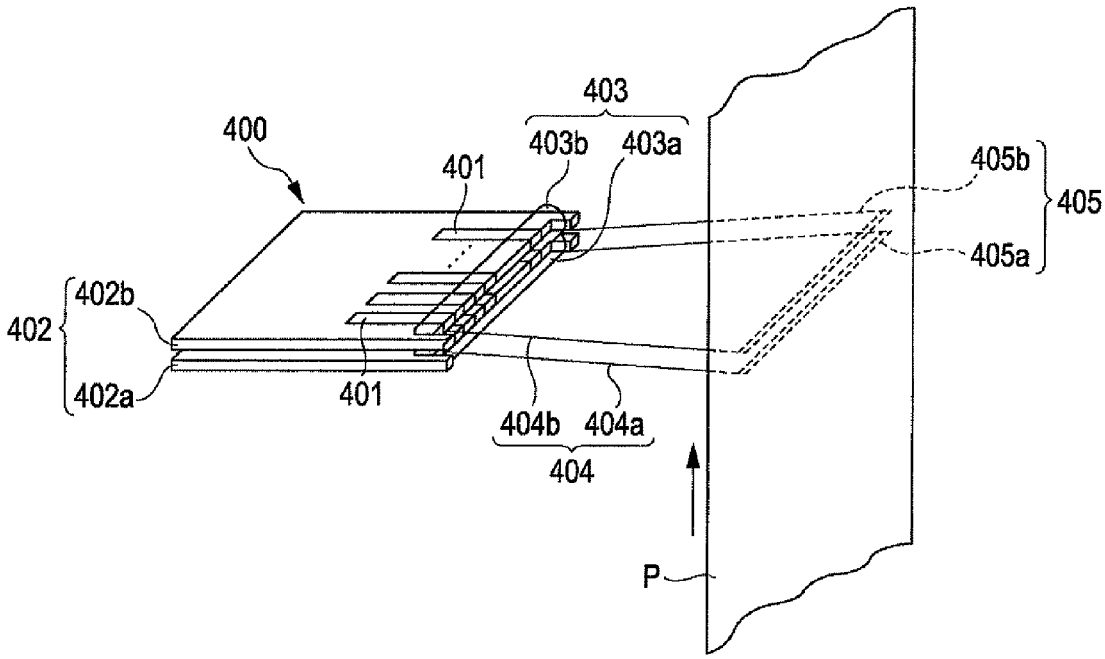
FIG. 10B is an explanatory view showing another example of a laser array.

FIG. 10B illustrates a laser array 400 including two substrates 402 (402*a*, 402*b*) that respectively have converging members 403 (403*a*, 403*b*) and are arranged in the recording-material transport direction. The plural substrates 402 (402*a*, 402*b*) may be arranged side by side. If the irradiation intensity of the single laser emitting element 401 is insufficient, irradiation may be repeated plural times to promote heating and melting of the toner. In this case, the plural substrates 402 are arranged substantially in parallel to one another, and irradiation regions 405 (405*a*, 405*b*) are provided in a plane. However, it is to be noted that the recording material P is transported while being curved, and the plural substrates 402 irradiate the curved recording material P with laser light 404 (404*a*, 404*b*). Components shown in FIG. 10B are substantially similar to components shown in FIG. 10A. Therefore, like reference signs refer like components, and the redundant description will be omitted.

Figure 11A:
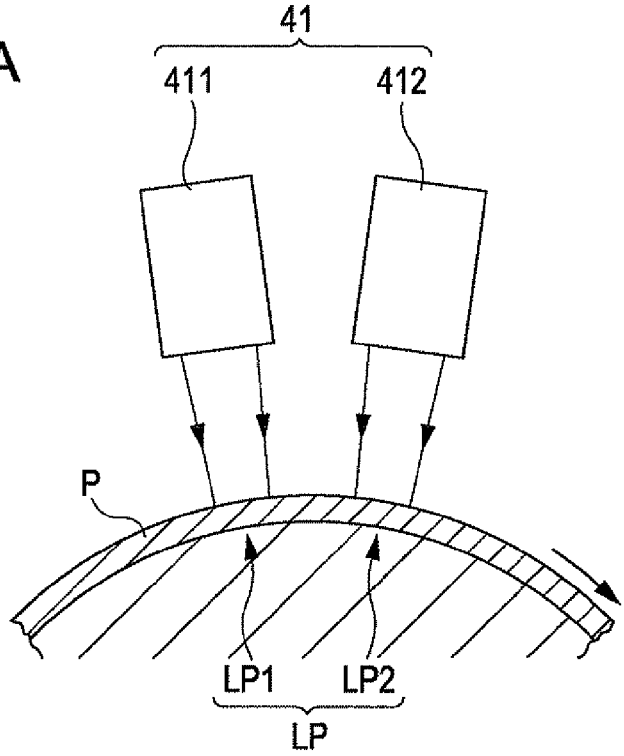
FIGS. 11A and 11B are explanatory views showing modifications of the fixing device according to the first exemplary embodiment, each fixing device having two laser irradiation devices.
Figure 11B:
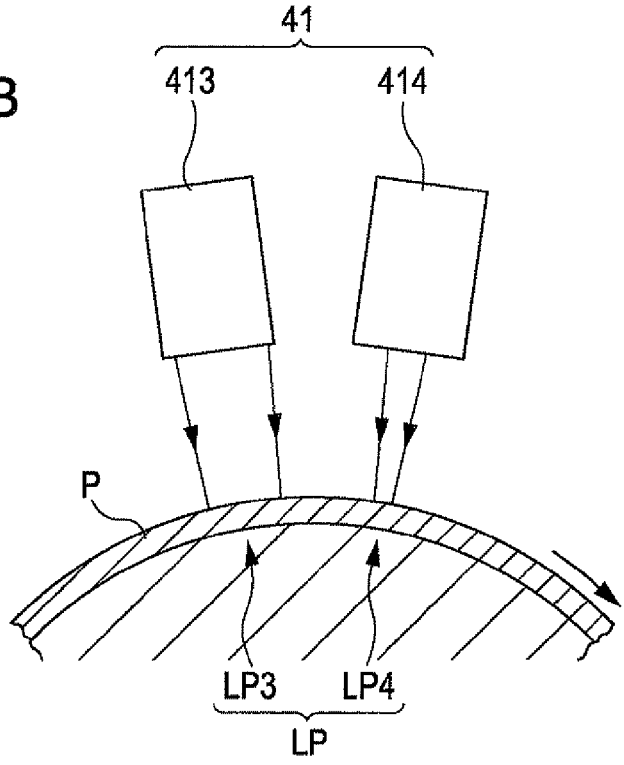

FIGS. 11A and 11B illustrate modifications of the laser irradiation device 41. Such laser irradiation devices 41 may be used. For the convenience of understanding, FIGS. 11A and 11B only illustrate the laser irradiation devices 41 and recording materials P.

In FIG. 11A, laser irradiation devices 411 and 412 are arranged in plural rows (two rows in this modification) in the recording-material transport direction. In this case, the laser irradiation devices 411 and 412 have similar lengths of irradiation ranges and similar irradiation intensities per unit area. Thus, the two laser irradiation devices 411 and 412 provide irradiation areas LP at two positions (LP1, LP2). With this configuration, the upstream laser irradiation device 411 irradiates toner on the recording material P with laser light first, and after a predetermined time elapses, the downstream laser irradiation device 412 irradiates the toner with laser light.

With this irradiation, if a portion with a high toner density is present on the recording material P (for example, a solid image portion), the upstream laser irradiation device 411 causes the temperature at the interface between the toner and the recording material P to be slightly increased. Then, during the period without the irradiation, the temperature is gradually decreased. However, since the surface area of the portion with the high toner density is small, the heat is released by a small amount. The decrease in temperature is small. Then, the downstream laser irradiation device 412 heats the portion with the high toner density again. Thus, the interface temperature is sufficiently increased, and sufficient adhesiveness is provided. Regarding a portion with a low toner density (for example, a highlighted image portion), the interface temperature is sufficiently increased; however, the temperature is rapidly decreased. The downstream laser irradiation device 412 heats the toner again, and hence the interface temperature is increased again. That is, the portion with the high toner density obtains the sufficient interface temperature by the two-time irradiation, whereas the portion with the low toner density obtains the sufficient interface temperature by the one-time irradiation. This operation is repeated.

Thus, regardless of the toner density on the recording material P, the sufficient adhesiveness is provided.

In FIG. 11B, two types of laser irradiation devices 413 and 414 are used. The laser irradiation devices 413 and 414 perform irradiation on two irradiation areas LP (LP3, LP4) with different irradiation conditions. In particular, the upstream laser irradiation device 413 has a lower irradiation intensity per unit area than that of the downstream laser irradiation device 414, but has a longer length of an irradiation range in the recording-material transport direction than that of the downstream laser irradiation device 414. Thus, the upstream laser irradiation device 413 provides a longer irradiation time than that of the downstream laser irradiation device 414. In this case, the upstream laser irradiation device 413 has the irradiation intensity and the length of the irradiation range capable of sufficiently heating and melting the toner.

With the irradiation, the upstream laser irradiation device 413 provides the sufficient adhesiveness at the portion with the high toner density. Hence, the downstream laser irradiation device 414 may perform the irradiation even for a short time. In contrast, the upstream laser irradiation device 413 does not sufficiently heat and melt the toner at the portion with the low toner density because the contact area between the toner particles and the outside air is large and the heat is released by a large amount. However, the downstream laser irradiation device 414 provides the high irradiation intensity, and hence sufficiently melts the toner. The sufficient adhesiveness is provided. That is, regardless of the image density on the recording material P, the toner is sufficiently heated and melted.

Second Exemplary Embodiment

Figure 12A:
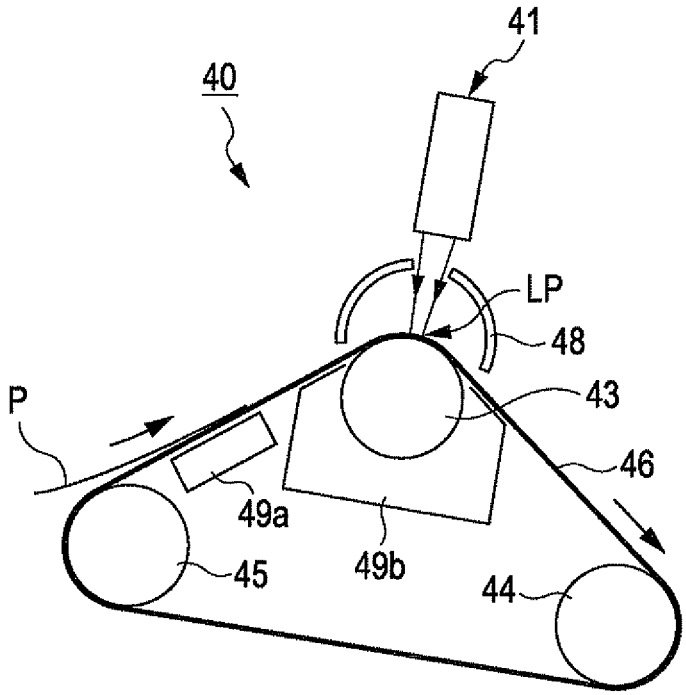
FIG. 12A is an explanatory view showing a fixing device according to a second exemplary embodiment.
Figure 12B:
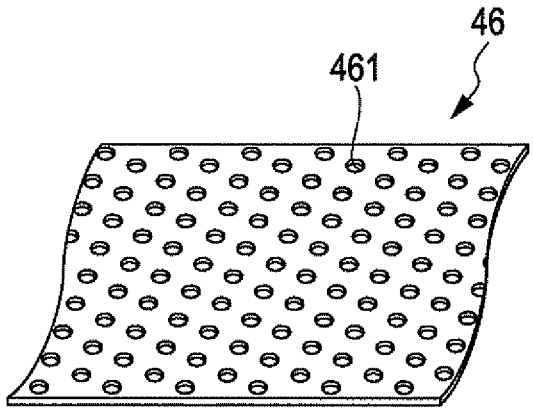
FIG. 12B is a perspective view showing a belt-like transport member.

FIGS. 12A and 12B are explanatory views each showing a fixing device 40 according to a second exemplary embodiment. The fixing device 40 according to this exemplary embodiment uses a belt-like transport member 46 different from the belt-like transport member 46 used in the fixing device 40 (see FIG. 4A) according to the first exemplary embodiment. Like reference signs refer like components according to the first exemplary embodiment, and the redundant description will be omitted.

Referring to FIG. 12A, the fixing device 40 according to this exemplary embodiment attracts a recording material P to the belt-like transport member 46 by using the air. Referring to FIG. 12B, the belt-like transport member 46 is formed, for example, by mixing a white pigment into a polyimide resin material and making plural very small holes 461 in the film-like member over the entire surface.

In this exemplary embodiment, two sucking devices 49*a* and 49*b* are provided at the back surface side of the belt-like transport member 46 such that the sucking devices 49*a* and 49*b* are located near to the belt-like transport member 46. The sucking devices 49*a* and 49*b* suck the air from the front surface side of the belt-like transport member 46 and exhaust the air outside the sucking devices 49*a* and 49*b*.

The effect of the fixing device 40 will be described.

When a recording material P with toner transferred thereon reaches the fixing device 40, the recording material P is guided to a position above the belt-like transport member 46 (in this exemplary embodiment, to a position near a support roller 45). Then, the recording material P is sucked by the first sucking device 49*a* to the surface of the belt-like transport member 46, and is transported through rotation of the belt-like transport member 46. Then, when the recording material P reaches the second sucking device 49*b*, the recording material P is guided to an irradiation area LP, and is irradiated with laser light. At this time, the air is sucked from the periphery of the support roller 43. The recording material P is transported while being sucked to the belt-like transport member 46. The recording material P after fixing with the laser light is separated from the belt-like transport member 46 by, for example, a separation claw, and is guided to an output roller 30 (see FIG. 3).

Although the support roller 43 is illustrated as a large roller in FIG. 12A, it is not limited thereto. For example, if the support roller 43 is small, the second sucking device 49*b* sucks the air properly. The surface of the support roller 43 reflects the laser light. For example, the support roller 43 is made of metal.

Figure 13:
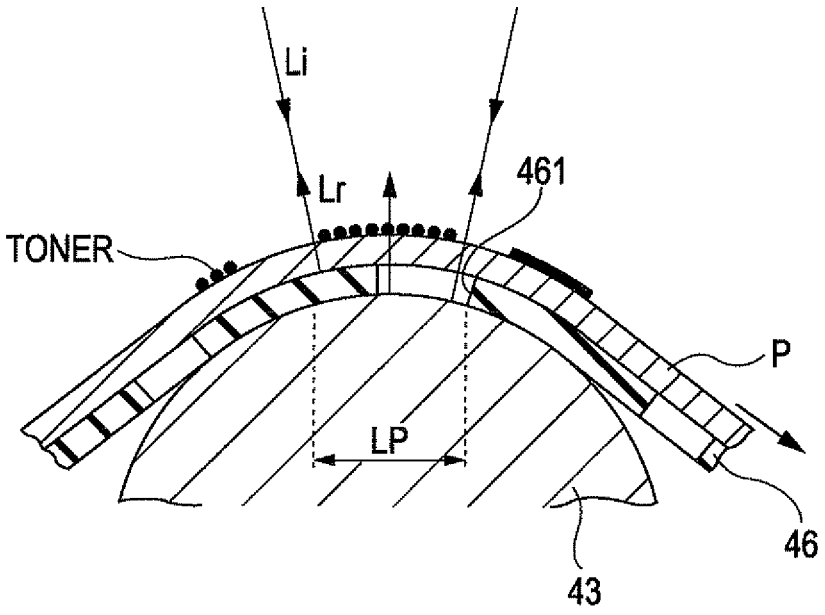
FIG. 13 is an explanatory view showing an effect by the fixing device according to the second exemplary embodiment.

FIG. 13 illustrates a relationship between the laser light and the recording material P in the irradiation area LP according to this exemplary embodiment. The toner on the recording material P located upstream the irradiation area LP in the recording-material moving direction is not fixed. The toner located downstream the irradiation area LP is fixed.

In this exemplary embodiment, since the belt-like transport member 46 has the holes 461, the reflecting surface for incident light Li may be changed. For example, as illustrated in FIG. 13, if the irradiation area LP includes a portion with the hole 461 and a portion without the hole 461, reflected light Lr is reflected from the surface of the support roller 43 at the portion with the hole 461, and reflected light Lr is reflected from the surface of the belt-like transport member 46 at the portion without the hole 461.

In this exemplary embodiment, since the recording material P is curved, waviness of the recording material P may be reduced like the first exemplary embodiment. Also, in this exemplary embodiment, since the surface of the belt-like transport member 46 and the surface of the support roller 43 are the reflecting surfaces, the incident light Li incident along the lines normal to the reflecting surfaces is directly reflected, and the irradiation area LP is irradiated with laser light by a substantially uniform light quantity. That is, the loss of the light quantity due to the hole 461 may be almost negligible.

Since the recording material P is sucked through the holes 461, the recording material P may be deformed in the irradiation area LP. However, the deformation is addressed if the size of the holes 461 is decreased. Also, the support roller 43 interrupts the sucking the air in the irradiation area LP. Accordingly, the deformation of the recording material P is almost negligible.

In this exemplary embodiment, the surface of the belt-like transport member 46 is the reflecting surface. However, the belt-like transport member 46 may be formed of a laser-light transmissive material, and the surface of the support roller 43 may be the reflecting surface. In this case, although the recording material P faces the surface of the belt-like transport member 46 and the hole 461 in the irradiation area LP, the reflected light Lr of the incident light Li may be reflected from the same reflecting surface. The holes 461 less affect the intensity of the reflected light Lr.

In this exemplary embodiment, the recording material P is cut paper. However, continuous paper may be used instead of the cut paper.

Third Exemplary Embodiment

Figure 14:
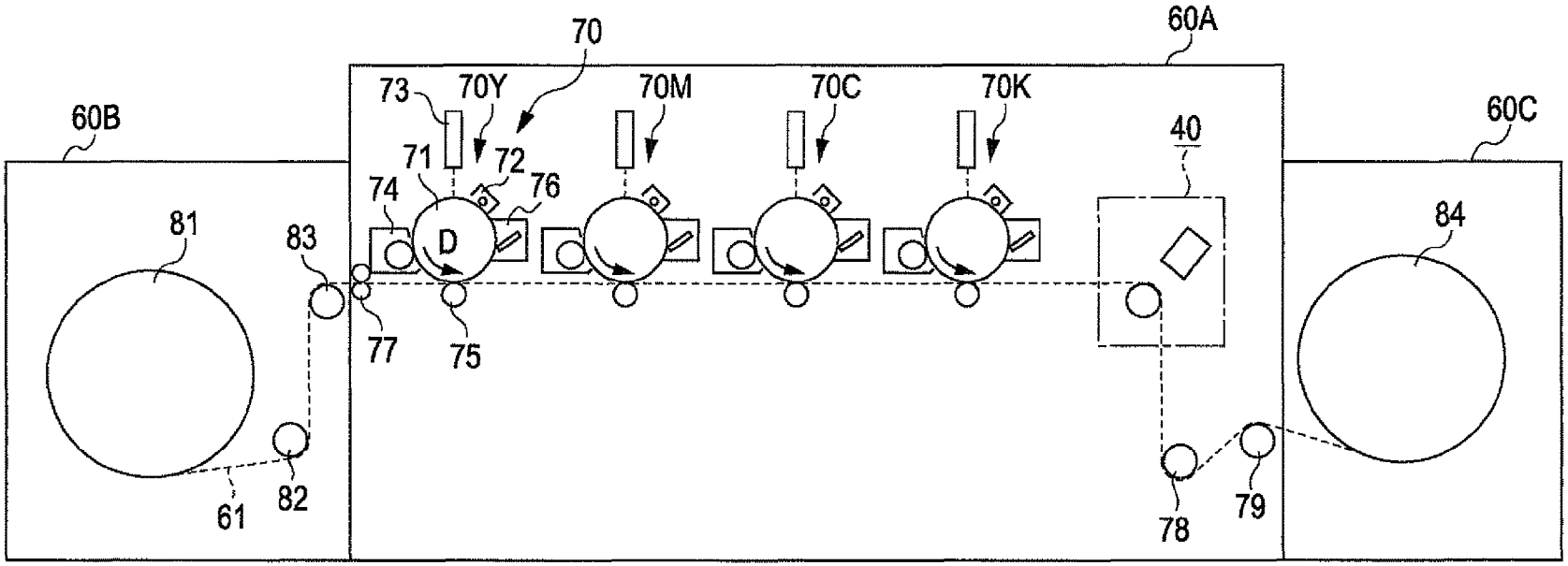
FIG. 14 is an explanatory view schematically showing an image forming apparatus according to a third exemplary embodiment.

FIG. 14 schematically illustrates an image forming apparatus according to a third exemplary embodiment of the invention using the fixing device 40 according to any one of the exemplary embodiments of the invention. The image forming apparatus in this exemplary embodiment differs from the image forming apparatus according to the first exemplary embodiment. The image forming apparatus according to this exemplary embodiment uses continuous paper 61 as a recording material. The image forming apparatus includes an image forming body 60A that forms an image on the continuous paper 61; a feed device 60B on one side of the image forming body 60A, the feed device 60B feeding the continuous paper 61; and a housing device 60C on the other side of the image forming body 60A, the housing device 60C housing the continuous paper 61 with the image formed thereon. The continuous paper 61 may have a roll form or a folded form. In this exemplary embodiment, the continuous paper 61 has the roll form.

In FIG. 14, the image forming body 60A according to this exemplary embodiment uses, for example, electrophotographic system. The image forming body 60A includes image forming units 70 of respective colors (specifically, a yellow image forming unit 70Y, a magenta image forming unit 70M, a cyan image forming unit 70C, and a black image forming unit 70K) that use, for example, four color toners as image forming materials and form toner images of plural colors on the continuous paper 61; a fixing device 40 that fixes the toner images formed in a superposed manner on the continuous paper 61 by the image forming units 70 of the respective colors, to the continuous paper 61; and tension applying rollers 78 and 79 that apply a tension to the continuous paper 61 after the fixing while transporting the continuous paper 61 toward the housing device 60C. Also, a position adjusting roller 77 is provided to adjust the position of the continuous paper 61 when the continuous paper 61 is guided to the image forming units 70.

The image forming units 70 have configurations similar to one another except that the image forming units 10 use toners of different colors. Therefore, the yellow image forming unit 70Y will be described for example. The yellow image forming unit 70Y includes a cylindrical photoconductive member 71 that includes a photoconductive layer (not shown) on the surface thereof and is rotatable in a direction indicated by arrow D. Provided around the photoconductive member 71 are a charging device 72 that electrically charges the photoconductive layer of the photoconductive member 71 to have a predetermined potential; an exposing device 73 that selectively irradiates the photoconductive layer charged by the charging device 72 with, for example, laser light to form an electrostatic latent image; a developing device 74 that develops the electrostatic latent image formed by the exposing device 73 with toner to visualize the image as a toner image; a transfer device 75 that transfers the toner image on the photoconductive member 71 onto the continuous paper 61; and a cleaner 76 that cleans remaining toner on the photoconductive member 71 after the toner image is transferred on the continuous paper 61.

The feed device 60B includes a feed roller 81 that holds the continuous paper 61 wound around a core member in a roll form, and tension applying rollers 82 and 83 that apply a tension to the continuous paper 61 while transporting the continuous paper 61 to the image forming body 60A. The housing device 600 includes a winding roller 84 that winds the continuous paper 61 around a core member to house the continuous paper 61.

In the image forming apparatus, the continuous paper 61 fed from the feed device 60B receives the toner images of the respective colors transferred thereon by the image forming units 70 of the respective colors in the image forming body 60A, and the toner images are superposed on the continuous paper 61. The fixing device 40 fixes the unfixed toner images transferred in a superposed manner on the continuous paper 61. Then, the housing device 60C winds and houses the continuous paper 61.

Figure 15:
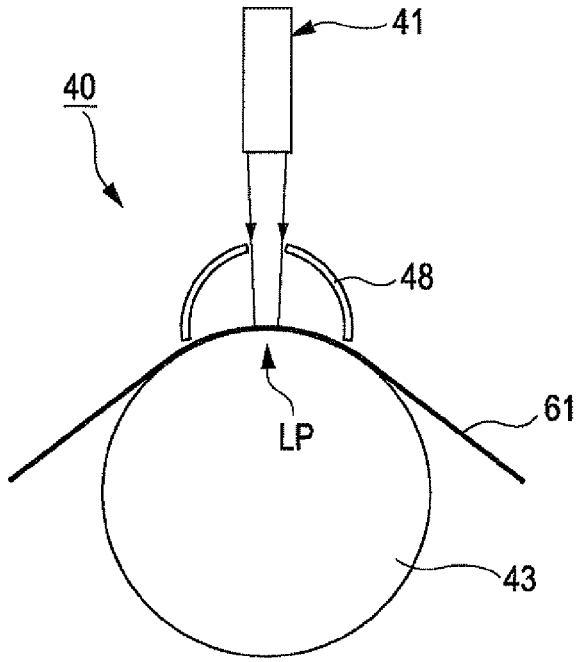
FIG. 15 is an explanatory view schematically showing a fixing device according to the third exemplary embodiment.

Next, the fixing device 40 in the image forming apparatus will be described on the basis of the overview of the fixing device 40 shown in FIG. 15. Referring to FIG. 15, the fixing device 40 according to this exemplary embodiment has a similar configuration to the configuration of the fixing device 40 (see FIG. 4A) according to the first exemplary embodiment, except that the recording material to be used is not the cut paper, but the continuous paper 61. Like reference signs refer like components according to the first exemplary embodiment, and the redundant description will be omitted.

The fixing device 40 according to this exemplary embodiment includes a laser irradiation device 41, a support roller 43 provided at a position to face the laser irradiation device 41 with the continuous paper 61 arranged therebetween, and a reflecting member 48 that reflects scattered light of laser light, which is emitted from the laser irradiation device 41 on an irradiation area LP and reflected from the continuous paper 61, toward the irradiation area LP. The laser light is emitted along the lines normal to the support roller 43. The continuous paper 61 is transported directly through rotation of the support roller 43. Hence, the support roller 43 is a metal roller member such as SUS, so that the surface of the support roller 43 reflects the laser light. The support roller 43 does not have to be made of metal, and may use a member made of synthetic resin as long as the surface of the member has reflectivity.

The effect when the fixing device 40 is used will be described.

Figure 16:
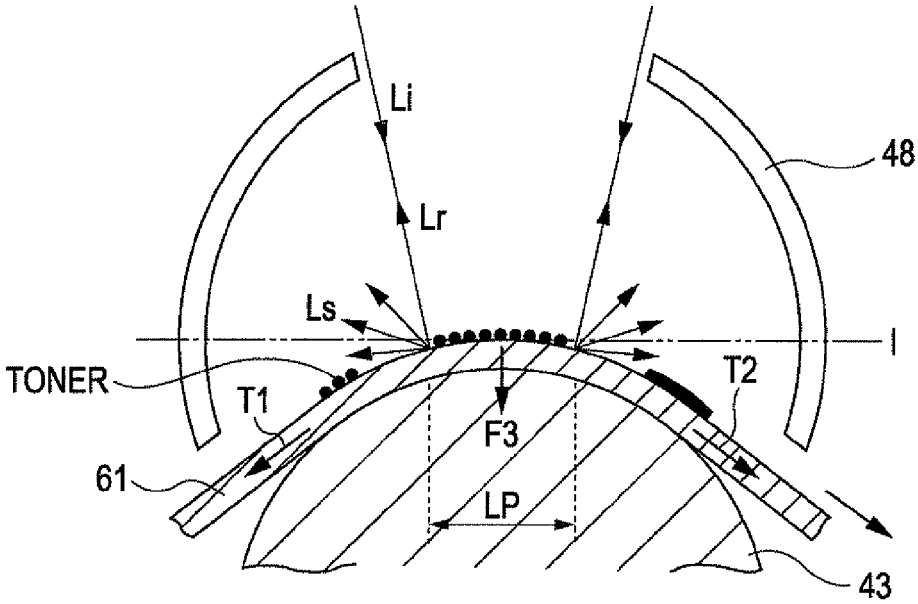
FIG. 16 is an explanatory view schematically showing an effect of the fixing device according to the third exemplary embodiment.

FIG. 16 illustrates a relationship between the laser light and the continuous paper 61 in the irradiation area LP. The toner on the continuous paper 61 located upstream the irradiation area LP in the transport direction of the continuous paper 61 is not fixed. The toner located downstream the irradiation area LP is fixed. In this exemplary embodiment, the continuous paper 61 is curved. Hence, a composite force F3 of tensions T1 and T2 acts on the continuous paper 61 toward the support roller 43. The continuous paper 61 is transported while being pressed to the support roller 43. Thus, waviness of the continuous paper 61 may be reduced. In this exemplary embodiment, incident light Li, which is emitted from the laser irradiation device 41 (see FIG. 15) to the irradiation area LP, and reflected light Lr, which is from the surface of the support roller 43 at the lower surface side of the continuous paper 61, are directed in opposite directions. That is, the incident light Li and the reflected light Lr in the irradiation area LP are directed along the lines normal to the surface of the curved portion of the support roller 43 in the irradiation area LP. Accordingly, a uniform light quantity is provided for the toner in the irradiation area LP.

Also, in this exemplary embodiment, a reflecting member 48 is provided to surround the irradiation area LP, and an end of the reflecting member 48 located near to the continuous paper 61 extends closer to the continuous paper 61 than a tangent to a center position of the irradiation area LP (the tangent being indicated by 1 in FIG. 16). Thus, the scattered light Ls of the incident light Li scattered from the surface of the continuous paper 61 is effectively received by the reflecting member 48, and is reflected again to the irradiation area LP.

Accordingly, the fixing may be efficiently performed with the laser light.

In any of the exemplary embodiments, the unfixed toner images formed on one side of the recording material are fixed. However, it is not limited thereto. Unfixed toner images formed on both sides of a recording material may be fixed.

For example, the support roller 43 shown in FIG. 15 may use a fluorocarbon resin material having a high lubricity, and the support roller 43 may be rotated at a peripheral speed equivalent to the transport speed of the recording material. Thus, the unfixed images may be prevented from adhering to the support roller 43. Alternatively, an oil supply device may be provided, so that the support roller 43 may be rotated at a peripheral speed equivalent to the transport speed of the recording material. Still alternatively, the support roller 43 may be formed of an oil bearing material. Since the roller member having oil on the surface is rotated at the peripheral speed equivalent to the transport speed of the recording material, even if the unfixed images are provided on both surfaces of the recording material, the recording material is transported without the unfixed images adhering to the roller member (the support roller 43).

For example, a cleaning member that cleans the surface of the support roller 43 may be provided for the support roller 43 shown in FIG. 15. In this case, even if toner adheres to the surface of the support roller 43, the surface is cleaned, and unwanted contamination may be prevented from occurring on the recording material.

Further, a cooling unit may be provided for the support roller 43. The cooling unit is effective particularly for duplex printing in which a toner image is formed on and fixed to one side of the recording material, and then a toner image is formed on the other side of the recording material. The temperature of the support roller 43, which comes into contact with the fixed toner image, is prevented from being increased. Thus, the toner is prevented from being melted again. The cooling unit may be cooling water or air that flows in the support roller 43 in the axial direction of the support roller 43.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a laser source that irradiates an image with laser light, the image being formed on a moving recording material with a thermoplastic image-forming material; and a support member arranged to face the laser source and having a curved portion, the curved portion being curved to protrude toward the laser source, such that the moving recording material curves along the curved portion in at least an irradiation area of the laser light, wherein the support member includes a belt-like transport member that holds and transports the recording material, and an opposite member that contacts a surface different from a recording-material transport surface of the belt-like transport member and causes the belt-like transport member to protrude toward the laser source.

2. The fixing device according to claim 1, further comprising a reflecting member provided between the laser source and the recording material supported by the support member, the reflecting member reflecting scattered light of the laser light emitted on the irradiation area on a surface of the recording material toward the irradiation area again.

3. The fixing device according to claim 2, wherein an end of the reflecting member located near to the support member is located closer to the support member than a tangent to part of the curved portion of the support member located nearest to the laser source.

4. The fixing device according to claim 1, wherein the curved portion of the support member has a reflecting surface capable of reflecting the laser light incident on the reflecting surface via the irradiation area on the surface of the recording material toward a range including at least the irradiation area.

5. The fixing device according to claim 1, wherein the curved portion of the support member has a reflecting surface capable of reflecting the laser light incident on the reflecting surface via the irradiation area on the surface of the recording material toward a range equivalent to the irradiation area.

6. The fixing device according to claim 1, wherein the support member is a roller member that rotates in the recording-material moving direction.

7. An image forming apparatus comprising:

an image forming unit that forms an image on a recording material by using a thermoplastic image-forming material; and the fixing device according to claim 1, the fixing device fixing the image formed on the recording material by the image forming unit with the thermoplastic image-forming material.

8. The image forming apparatus according to claim 7, wherein the image forming apparatus uses the recording material continuously extending in the recording-material moving direction.

* * * * *